US006471338B2

(12) United States Patent
Chen et al.

(10) Patent No.: US 6,471,338 B2
(45) Date of Patent: Oct. 29, 2002

(54) MICROINJECTOR HEAD HAVING DRIVER CIRCUITRY THEREON AND METHOD FOR MAKING THE SAME

(75) Inventors: Chih-Ching Chen, Taipei (TW); Tsung-Wei Huang, Taipei (TW)

(73) Assignee: Benq Corporation, Taoyuan (TW)

( * ) Notice: Subject to any disclaimer, the term of this patent is extended or adjusted under 35 U.S.C. 154(b) by 0 days.

(21) Appl. No.: 09/683,462

(22) Filed: Jan. 3, 2002

(65) Prior Publication Data

US 2002/0097301 A1 Jul. 25, 2002

(30) Foreign Application Priority Data

Jan. 19, 2001 (TW) ..... 90101314 A

(51) Int. Cl.[7] ..... B41J 2/05; B21D 53/76
(52) U.S. Cl. ..... 347/59; 347/65; 29/890.1
(58) Field of Search ..... 347/59, 48, 65, 347/58, 57, 94; 29/890.1; 437/51

(56) References Cited

U.S. PATENT DOCUMENTS 4,695,853 A 9/1987 Hackleman et al.
4,947,192 A 8/1990 Hawkins et al.
5,122,812 A * 6/1992 Hess et al. ..... 346/1.1
5,216,447 A 6/1993 Fujita et al.
5,726,697 A 3/1998 Shimoda
6,102,530 A * 8/2000 Kim et al. ..... 347/65

FOREIGN PATENT DOCUMENTS

EP 0317171 A3 5/1989
EP 0493897 7/1992

* cited by examiner

*Primary Examiner*—Craig Hallacher
*Assistant Examiner*—Charles W. Stewart, Jr.
(74) *Attorney, Agent, or Firm*—Winston Hsu

(57) ABSTRACT

A microinjector head with a driving circuit and the manufacturing method of the microinjector head are shown. The microinjector head uses a bubble as a virtual valve to eject fluid. The microinjector head has a manifold, chambers, a pair of first and second bubble generators, orifices, and a driving circuit. The driving circuit is used to control the pair of first and second bubble generating devices and eject fluid inside the corresponding chamber from the corresponding orifice. In addition, because the driving circuit and the bubble generators are integrated on a single substrate, the number of manufacturing processes is reduced and the circuit devices and connecting circuits of the. microinjector array are fewer.

49 Claims, 12 Drawing Sheets

MICROINJECTOR HEAD HAVING DRIVER CIRCUITRY THEREON AND METHOD FOR MAKING THE SAME

BACKGROUND OF INVENTION

1. Field of the Invention

The invention relates to a microinjector head and its manufacturing method, and more particularly, to a microinjector head with a driving circuitry and the manufacturing method of the microinjector head.

2. Description of the Prior Art

At present, droplet injectors are widely applied in inkjet printers. Droplet injectors also have many other applications in different fields such as fuel injection systems, cell sorting, drug delivery systems, direct print lithography and micro jet propulsion systems. The common aim of the above applications is to provide a droplet injector that is reliable, of low-cost, and provides high-quality droplets with a high frequency and a high spatial resolution.

However not all apparatuses can successfully inject uniform droplets. In currently known and used droplet injection systems, one system using thermally driven bubbles to inject droplets is proved to be a successful system because of its comparatively simple architecture and lower cost.

U.S. Pat. No. 6,102,530-"Apparatus and method for using bubbles as virtual valve in microinjector to eject fluid" mentions a droplet injection apparatus with virtual valves as shown in FIG. 1. Heaters 20, 22 are located around orifices 18. A first bubble is generated between a manifold 16 and a fluid chamber 14. Therefore the first bubble acts like a virtual valve and is capable of reducing a cross talk effect with the adjacent chambers. A second bubble is then generated and approaches the first bubble to push the fluid, causing a droplet to be ejected from the orifice 18. Finally, the second bubble fuses with the first bubble and successfully reduces the production of satellite droplets.

U.S. Pat. No. 5,122,812-"Thermal inkjet print head having driver circuitry thereon and method for making the same" mentions a structure of an inkjet print head with driving circuitry as shown in FIG. 2. Heating devices and driving circuitry are integrated on a same substrate. However there are still many steps in the process. And according to the structure, a barrier layer 130 of 20~30 $\mu$m in thickness must be formed and an orifice plate is adhered on the barrier layer 130. This adhesion procedure limits the spatial resolution due to unavoidable assembly tolerance. In addition, the adhesion procedure is not compatible with general IC processes. When microinjector arrays are integrated with driving circuitry to reduce layout and are tightly packed, such incompatibility problems become more obvious and lead to more complicated manufacturing processes and thus higher costs.

SUMMARY OF INVENTION

It is therefore a primary objective of the claimed invention to provide a microinjector head with driving circuitry to control a plurality of first and second bubble-generating devices to eject fluid in a plurality of chambers from orifices. A secondary objective of the claimed invention is to provide a manufacturing method for making a microinjector head with driving circuitry in fewer steps and with fewer number of circuit devices and linking circuits.

According to the claimed invention, the microinjector head with driving circuitry to eject fluid uses a bubble as a virtual valve. The microinjector head comprises a plurality of chambers, a manifold connected to the chambers for providing fluid to the chambers, a plurality of orifices open to corresponding chambers, a plurality of pairs of bubble generators, each pair of bubble generators comprising a first and a second bubble-generating devices near a corresponding orifice and above the corresponding chamber, the first bubble-generating device generating a first bubble that is used as a virtual valve, the second bubble-generating device generating a second bubble to cause liquid in the chamber to eject from the orifice when the chamber is filled with fluid, and a driving circuit comprising a plurality of functional devices disposed on a same substrate. The driving circuit can send a driving signal to a specific pair of bubble generators so as to eject droplets out of the corresponding orifices. The first bubble generator and the second bubble generator may be two resistive heaters with different resistances and may be connected to each other in series.

It is an advantage of the claimed invention that the microinjector head and the manufacturing method provide a micro droplet injector head manufactured with lower cost and fewer procedures.

These and other objects and the advantages of the present invention will no doubt become obvious to those of ordinary skill in the art after having read the following detailed description of the preferred embodiment that is illustrated in the various figures and drawings.

DETAILED DESCRIPTION

Figure 1:
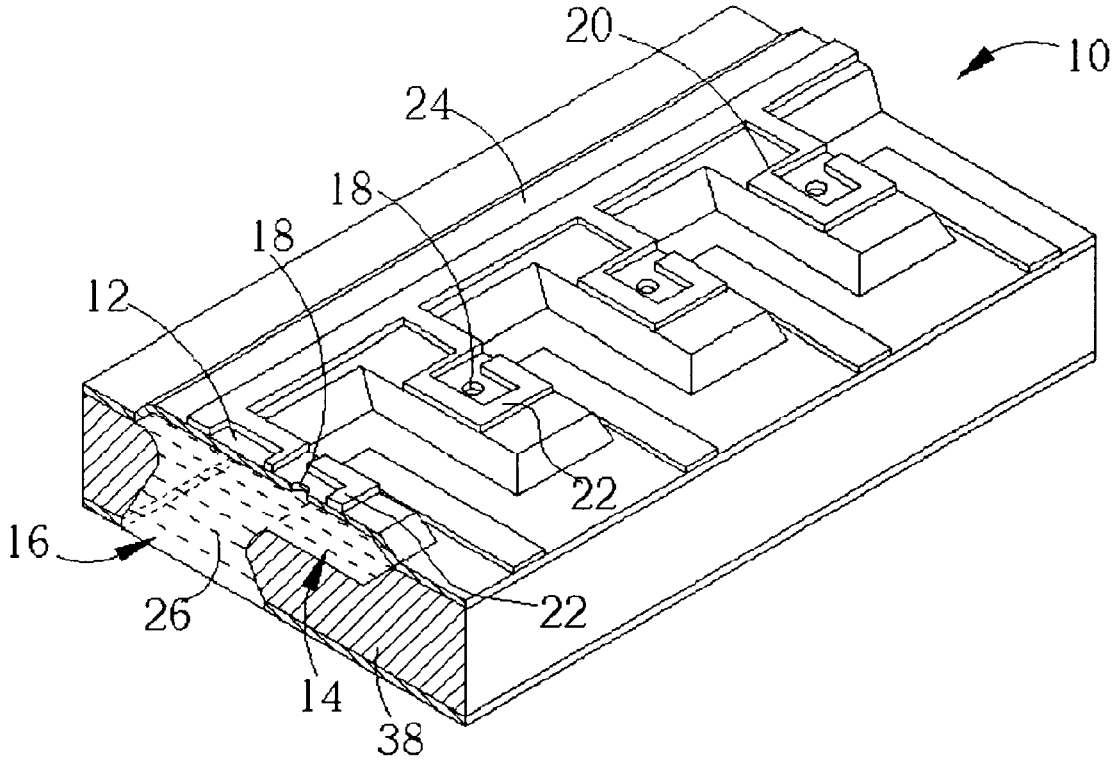
Fig. 1 Prior art
FIG. 1 is a structural diagram of a prior art droplet injection apparatus with virtual valves.
Figure 2:
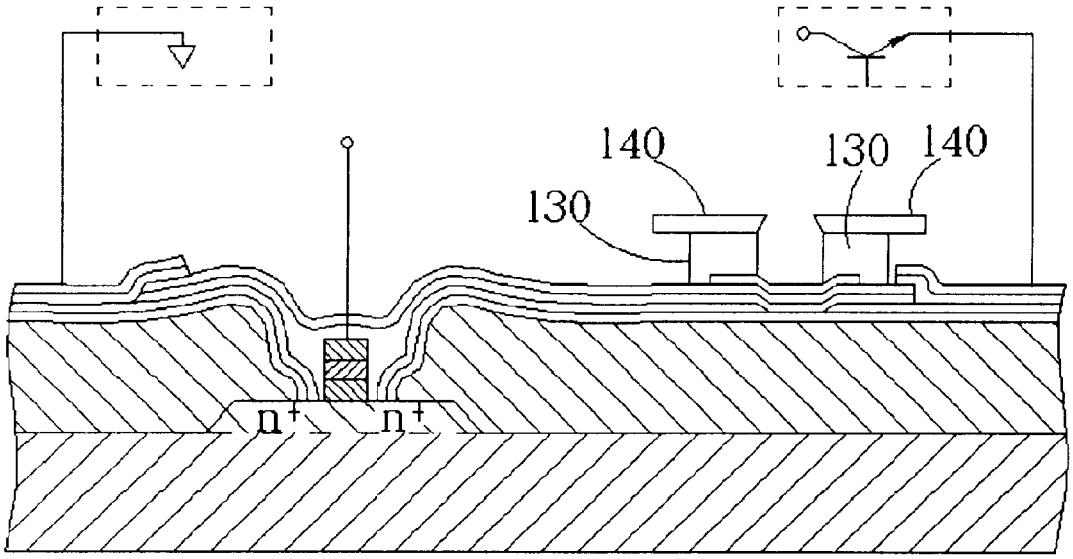
Fig. 2 Prior art
FIG. 2 is a structural dissection diagram of a prior art microinjector head with driving circuitry.
Figure 3:
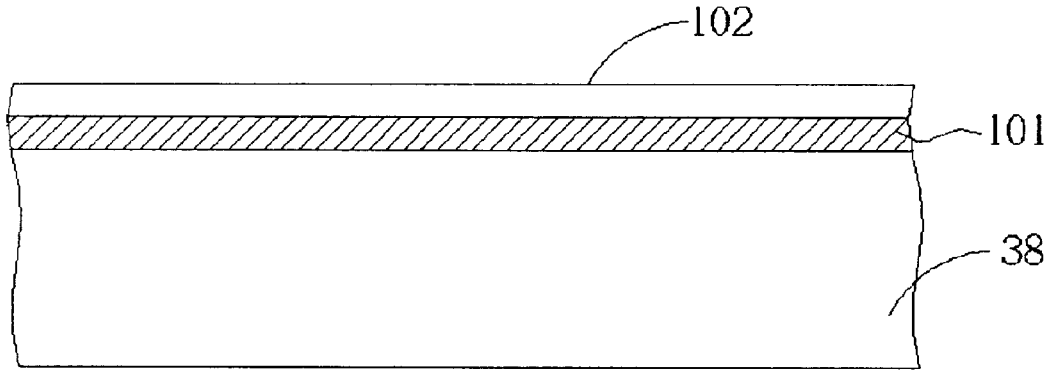
FIG. 3 to FIG. 8 are structural and schematic diagrams of procedures to manufacture the microinjector head with driving circuitry and structural diagrams of the microinjector head.
Figure 4:
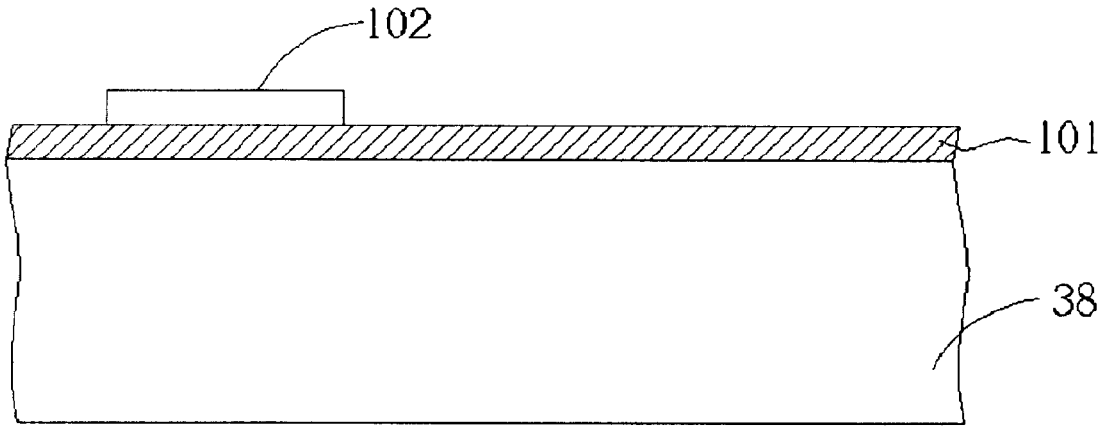
Figure 5:
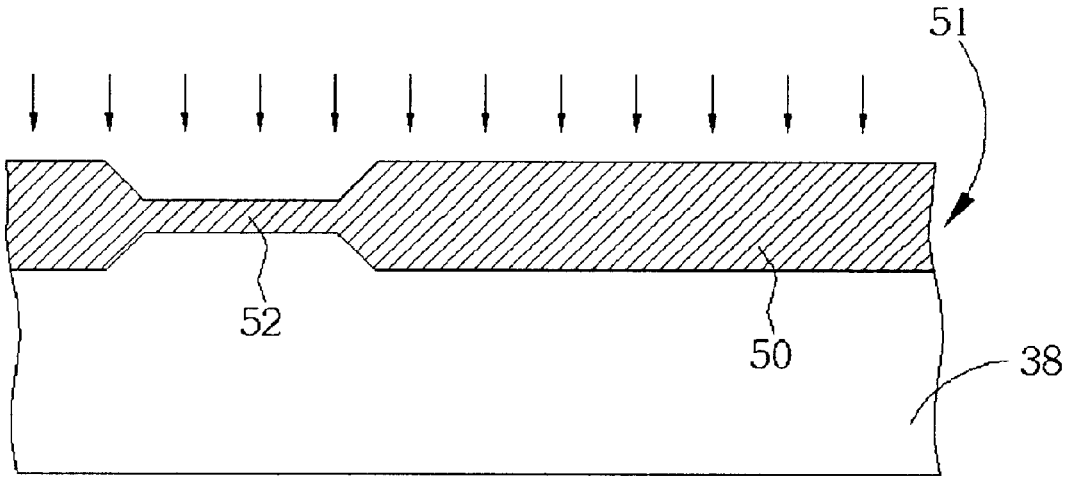
Figure 6:
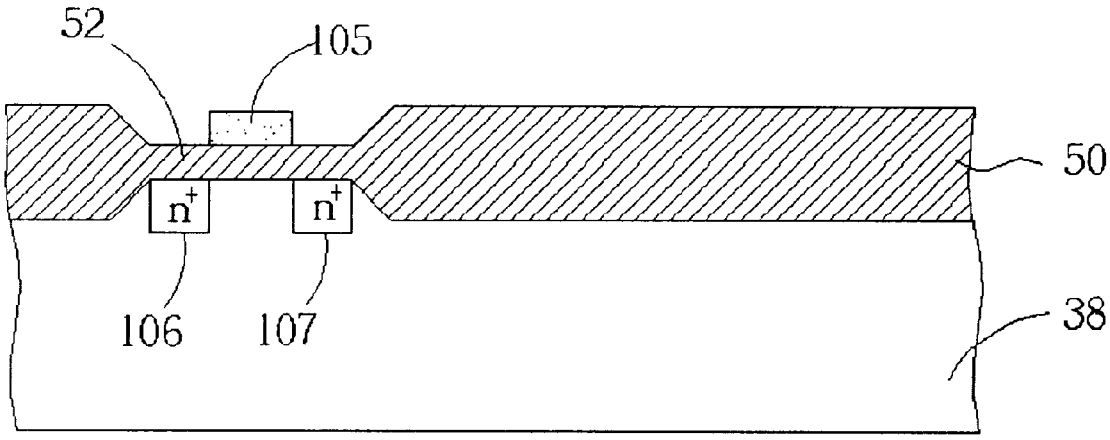

The present invention offers an improvement over the prior art. Therefore, references to items shown in FIG. 1 and FIG. 2 will be made in the following description. As shown in FIGS. 3 to FIG. 5, making a microinjector array 10 with driving circuitry on a substrate 38 comprises forming a thin oxide layer 101 on the substrate 38, forming a silicon nitride ($SiN_x$) layer 102 on the thin oxide layer (as shown in FIG. 3), exposing and developing a silicon nitride layer 102, etching the silicon nitride layer 102 (as shown in FIG. 4), and using local oxidation to oxidize unprotected regions of the thin oxide layer 101 to form a field oxide layer. Until now, a dielectric layer 51 (as shown in FIG. 5) is formed and has a first part 52 and a second part 50. The first part 52 is a part of the thin oxide layer 101 covered by silicon nitride layer 102. The second part 50 is the field oxide layer formed by local oxidation. This field oxide layer can be etched in the following procedures to form the chambers 14. Then the silicon nitride layer 102 is removed. Blanket boron ion implantation of the first part 52 and the second part 50 (as shown in FIG. 5) adjusts the threshold voltage of the driving circuit. A polysilicon gate 105 is formed on the first part 52 and a phosphorus ion implantation of the polysilicon gate 105 is performed to reduce resistance of the polysilicon gate 105. Implanting arsenic ions in the substrate 38 forms a source 106 and a drain 107 close to the gate 105. Therefore plural functional devices, which comprise the source 106, the drain 107, and the gate 105, are formed on the substrate 38 (as shown in FIG. 6).

Figure 7:
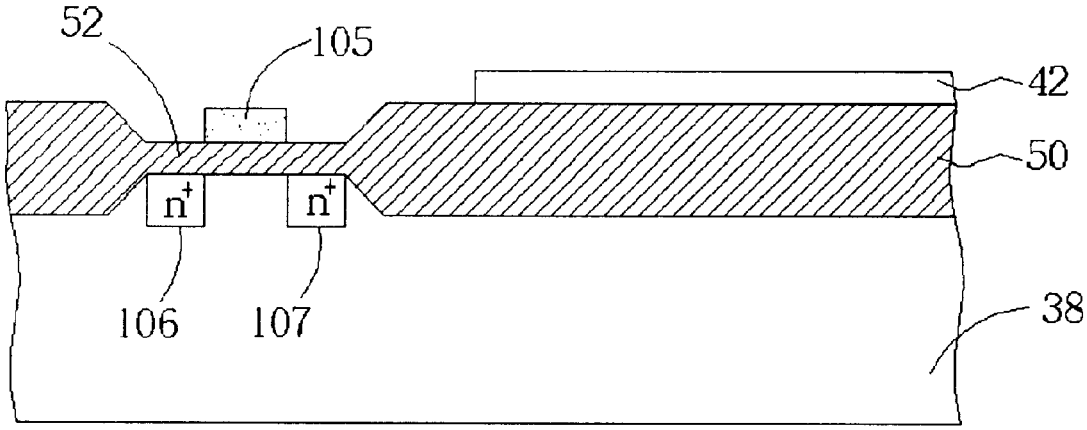

Please refer to FIG. 7. A low stress layer 42, like $SiN_x$, is deposited on the second part 50 as an upper layer of chambers 14.

Figure 8:
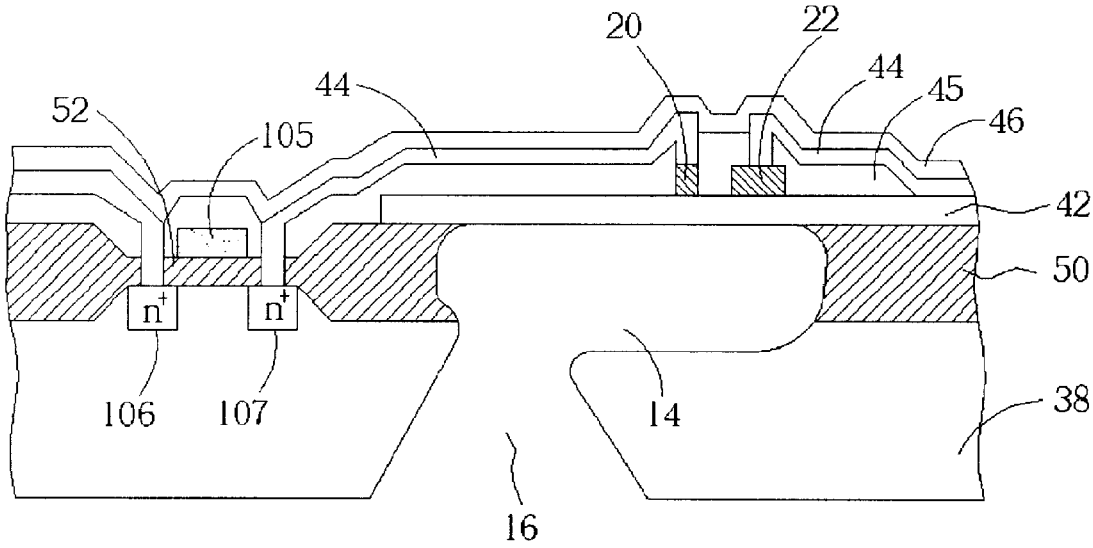

Please refer to FIG. 8. An etching solution KOH is used to etch a back side of the substrate 38 to form a manifold 16 for fluid supply, and then the second part 50 is removed by the etching solution HF. The etching time is precisely controlled to perform another etching using KOH to increase the depths of the chambers 14. So the chambers 14 and the manifold 16 are connected and are capable of being filled with fluid. However this etching process needs special concern because the convex corners will also be etched.

Heaters, including first heaters 20 and second heaters 22 are arranged in a pattern for helping to generate bubbles and eject droplets. The first heaters 20 and the second heaters 22 may be made of an alloy of tantalum and aluminum in a preferred embodiment. However, other materials or alloys, such as platinum or $HfB_2$, may also be the material of the first heaters 20 and the second heaters 22. To protect the first heaters 20 and the second heaters 22 and isolate the plural functional devices, a low temperature oxide layer 45 is deposited as a protection layer on the whole substrate 38 which includes the gate 105, the source 106, the drain 107, and the second part 50.

A conductive layer 44 is formed on the first heaters 20 and the second heaters 22 to connect the first heaters 20, the second heaters 22, and the functional devices of the driving circuit. The driving circuit including a plurality of functional devices can transmit driving signals to independently drive each of a specific pair of heaters (the first heaters 20 and the second heaters 22) and drive a plurality of pairs of heaters (the first heaters 20 and the second heaters 22), so fewer circuit elements and circuit lines are required. For example, in the preferred embodiment, the first heaters 20 and the second heaters 22 are connected in series. The driving circuit may use a matrix to control and activate a specific pair of heaters to generate bubbles and eject droplets. For example, the driving circuit sends a column signal to select a column of pairs of heaters, and sends a row signal to further select a specific pair of heaters out of the column of pairs of heaters. The conductive layer 44 may be made of an alloy of aluminum-silicon-copper in a preferred embodiment. The conductive layer 44 may also be made of aluminum, copper, gold, tungsten, or other materials. Afterwards, a low temperature oxide layer 46 is deposited as a protection layer on the conductive layer 44.

Figure 9:
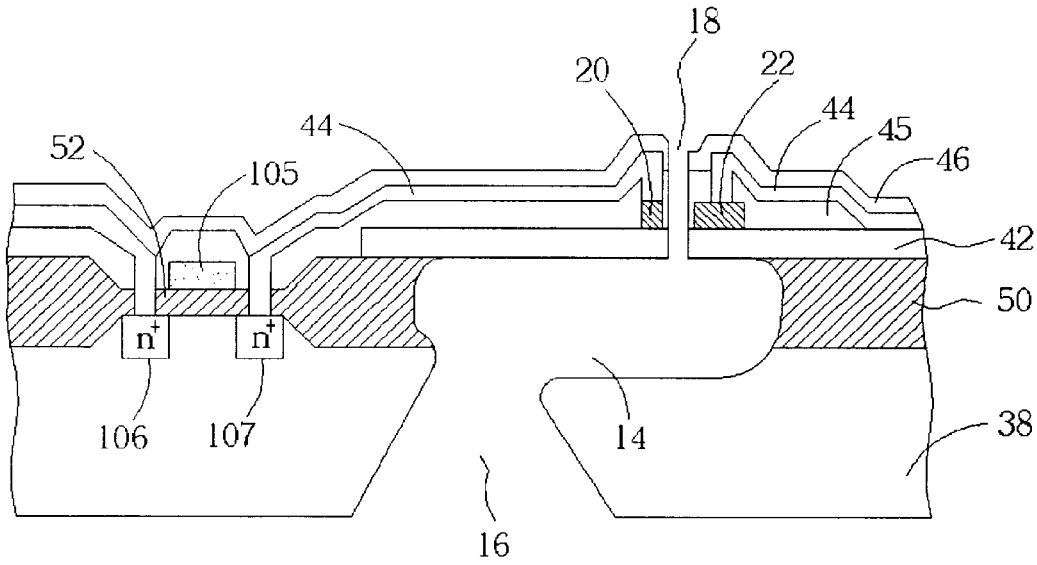
FIG. 9 is a structural and schematic diagram of the microinjector head with driving circuitry of the present invention.

Please refer to FIG. 9. An orifice 18 formed between the first heater 20 and the second heater 22. If a line width of 3 $\mu$m is allowed in photolithography, the diameter of the orifice 18 can be as small as 2 $\mu$m. The pitch between the orifice 18 and an adjacent orifice 18 can be as small as 15 $\mu$m. Until now, a microinjector array with driving circuitry in one piece is formed. The driving circuitry and heaters are integrated on the same substrate 38 and an integral microinjector head structure is formed without the need of adhesion of an orifice plate.

Figure 10:
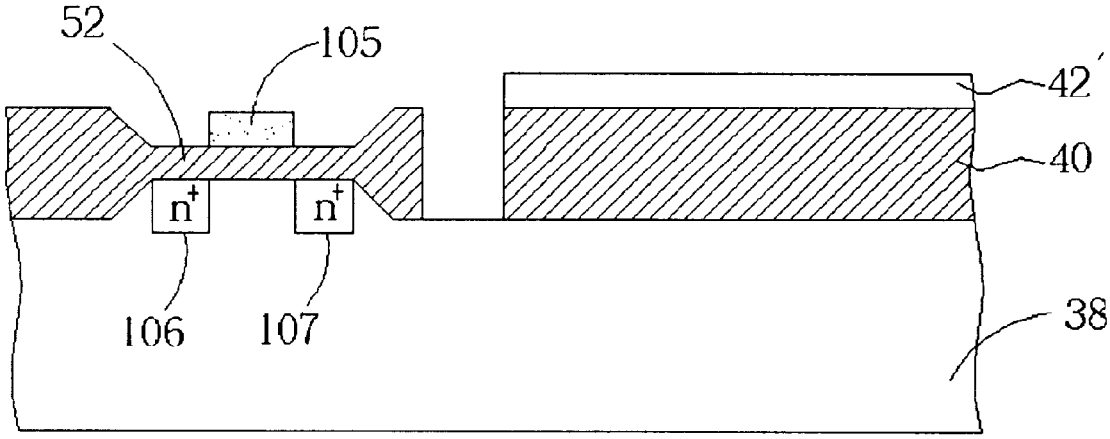
FIG. 10 to FIG. 12 are structural and schematic diagrams of a second embodiment of procedures to manufacture the microinjector head with driving circuitry and structural diagrams of the microinjector head.

The following is a description of another embodiment of the present invention. Compared with the first embodiment, the difference lies in the process of directly etching the second part 50 of FIG. 6 to form the chamber 14 as shown in FIGS. 7, 8, and 9. This embodiment first etches a part of the second part 50 and forms a sacrificial layer 40 on the etched position, then performs upcoming processes. Please refer to FIG. 10. FIG. 10 continues the process of FIG. 6. A partial etching of the second part 50 of FIG. 6 is performed, and an oxide layer 40 is deposited on a part of the substrate 38 uncovered by the driving circuit so as to become a sacrificial layer 40 of the chamber 14. A low stress layer 42" is then deposited as the top of chamber 14.

Figure 11:
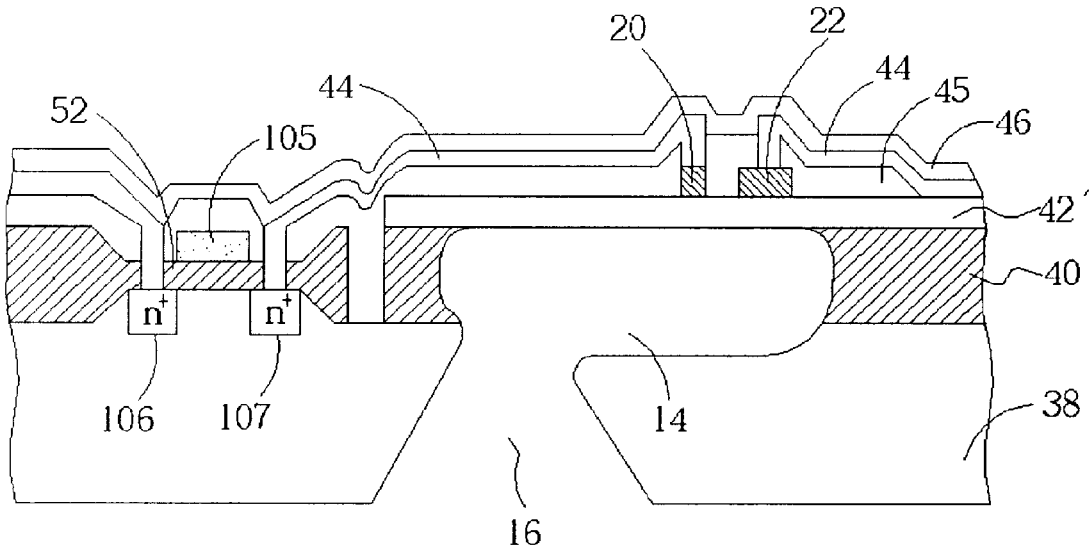
Figure 12:
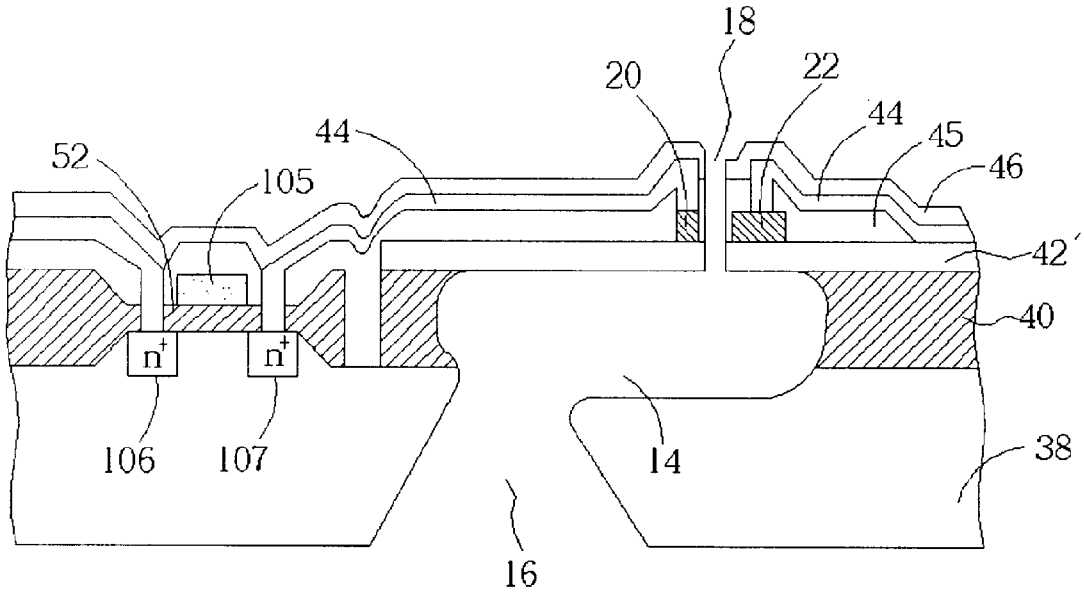

Please refer to FIG. 11 and FIG. 12, which are similar in their processes to those of FIG. 8 and FIG. 9. As shown in FIG. 11, the substrate 38 and the sacrificial layer 40 are etched from the back side to form the manifold 16 and the chambers 14. The first heater 20, the second heater 22 and the protective low temperature oxide layer 45 are deposited. A conductive layer 44 is formed to conduct the first heater 20, the second heater 22, and the driving circuit and to deposit a low temperature oxide layer 46 on the conductive layer 44 as a protective layer. Finally, as shown in FIG. 12, photolithography is utilized to form an orifice 18 between the first heater 20 and the second heater 22. Then a microinjector array with driving circuitry to drive the first heater 20 and the second heater 22 is formed.

The order of the above processes can be changed according to real situations while still manufacturing a micro droplet injector head with appropriate driving circuitry.

It is an advantage of the present invention that the microinjector head with a plurality of microinjectors and corresponding driving circuitry according to the present invention has driving circuitry and microinjectors integrated on a same substrate. The number of processes is fewer. In addition, the structure of the microinjector head with driving circuitry has fewer circuit elements and connecting circuits.

Those skilled in the art will readily observe that numerous modifications and alterations of the present invention may be made while retaining the teachings of the invention. Accordingly, the above disclosure should be construed as limited only by the metes and bounds of appended claims.

What is claimed is:

1. A method for making a microinjector head with driving circuitry, comprising:

providing a substrate;

forming a dielectric layer having a first part and a second part on the substrate, said forming comprising:

forming a thin oxide layer on the substrate;

forming a silicon nitride layer on the thin oxide layer;

oxidizing exposed regions of the thin oxide layer by local oxidation to form a field oxide, wherein the thin oxide layer covered by the silicon nitride layer is the first part of the dielectric layer, and the field oxide is the second part of the dielectric layer; and removing the silicon nitride layer;

forming a driving circuit containing a plurality of functional devices on the first part of the dielectric layer;

forming a low-stress material layer on the second part of the dielectric layer;

etching the substrate and the dielectric layer to form a manifold and a plurality of fluid chambers, the manifold and the fluid chambers being connected to supply fluid to the chambers;

forming aplurality of bubble generators on the low-stress material layer, the bubble generators connected to the driving circuit; and forming an orifice opening to the corresponding chamber to eject the fluid.

2. The method of claim 1 for making a microinjector head with driving circuitry wherein forming the driving circuit comprises:

implanting boron ions into the dielectric layer;

forming a polysilicon gate on the first part of the dielectric layer; and implanting arsenic ions into the substrate for forming a source and a drain close to the gate.

3. The method of claim 1 for making a microinjector head with driving circuitry wherein the etching of the substrate and the dielectric layer to form the manifold and the chambers comprises:

back-side etching the substrate for forming the manifold;

removing the second part of the dielectric layer; and etching the substrate for forming the chambers.

4. The method of claim 1 for making a microinjector head with driving circuitry wherein each bubble generator has a first bubble-generating device for generating a first bubble as a virtual valve between the chamber and the manifold and a second bubble-generating device for generating a second bubble approaching the first bubble.

5. The method of claim 4 for making a microinjector head with driving circuitry wherein forming the first bubble-generating devices and the second bubble-generating devices comprise:

forming a resistor layer on the low-stress material layer for forming a first heater as the first bubble-generating device and a second heater as the second bubble-generating device; and forming a conductive layer on the resistor layer, the conductive layer and the resistor layer being connected.

6. The method of claim 5 for making a microinjector head with driving circuitry wherein between the formation of the resistor layer and the conductive layer a first oxide layer is formed on the resistor layer for protecting the first heater and the second heater.

7. The method of claim 1 for making a microinjector head with driving circuitry further comprising forming a second protection layer on the bubble generators for protecting the bubble generators.

8. A method for making a microinjector head with driving circuitry, the method comprising:

providing a substrate;

forming a dielectric layer having a first part and a second part on the substrate;

forming a driving circuit having a plurality of functional devices on the first part of the dielectric layer;

etching a portion of the second part of the dielectric layer, a sacrificial layer being formed on the etched portion of the second part of the dielectric layer;

forming a low-stress material layer on the sacrificial layer;

etching a non-driving circuit portion of the substrate and the sacrificial layer for forming a manifold and a plurality of chambers, the manifold being connected to the chambers for providing fluid to the chambers, said etching comprising:

back-side etching the substrate for forming the manifold;

removing the sacrificial layer that does not cover the driving circuit; and back-side etching the substrate for forming the chambers;

forming a plurality of bubble generators on the low-stress material layer, the bubble generators connected to the driving circuit; and forming a plurality of orifices, each orifice connected to the chambers for ejecting the fluid.

9. The method of claim 8 for making a microinjector head with driving circuitry wherein formation of the dielectric layer comprises:

forming a thin oxide layer on the substrate;

forming a silicon nitride layer on the thin oxide layer;

local oxidizing the thin oxide layer not covered by the silicon nitride layer for forming a field oxide layer, wherein the thin oxide layer covered by the silicon nitride layer is the first part of the dielectric layer, and the field oxide layer is the second part of the dielectric layer; and removing the silicon nitride layer.

10. The method of claim 8 for making a microinjector head with driving circuitry wherein formation of the driving circuit comprises:

boron ion implanting on the dielectric layer;

forming a polysilicon gate on the first part of the dielectric layer; and arsenic ion implanting on the substrate for forming a source and a drain close to the gate.

11. The method of claim 8 for making a microinjector head with driving circuitry wherein the driving circuit is used for independently sending driving signals to each of the plurality of the bubble generators and for driving the plurality of the bubble generators.

12. The method of claim 8 for making a microinjector head with driving circuitry wherein the functional device is a transistor.

13. The method of claim 12 for making a microinjector head with driving circuitry wherein the transistor is a metal oxide semiconductor field effect transistor (MOSFET).

14. The method of claim 8 for making a microinjector head with driving circuitry wherein each of the bubble generators has a first bubble-generating device and a second bubble-generating device.

15. The method of claim 14 for making a microinjector head with driving circuitry wherein the formation of the bubble generators comprises:

forming a resistor layer on the low-stress material layer for forming a first heater as the first bubble-generating device and a second heater as the second bubble-generating device; and forming a conductive layer on the resistor layer, the conductive layer connected to the driving circuit.

16. The method of claim 15 for making a microinjector head with driving circuitry wherein between the formation of the resistor layer and the conductive layer a first oxide layer is formed on the resistor layer for protecting the first heater and the second heater.

17. The method of claim 8 for making a microinjector head with driving circuitry wherein the method further comprises forming a second oxide layer on the bubble generators for protecting the bubble generators.

18. A method for making a microinjector head with driving circuitry, comprising:

providing a substrate;

forming a dielectric layer having a first part and a second part on the substrate;

forming a driving circuit containing a plurality of functional devices on the first part of the dielectric layer;

forming a low-stress material layer on the second part of the dielectric layer;

etching the substrate and the dielectric layer to form a manifold and a plurality of fluid chambers, the manifold and the fluid chambers being connected to supply fluid to the chambers;

forming a plurality of bubble generators on the low-stress material layer, each bubble generator comprising a first bubble-generating device and a second bubble generating device, the bubble generators connected to the driving circuit;

forming a resistor layer on the low-stress material layer for forming a first heater as the first bubble-generating device and a second heater as the second bubble-generating device;

forming a conductive layer on the resistor layer, the conductive layer and the resistor layer being connected; and forming an orifice opening to the corresponding chamber to eject the fluid;

wherein the first bubble-generating device of each bubble generator is for generating a first bubble as a virtual valve between the chamber and the manifold, and a second bubble-generating device of each bubble generator is for generating a second bubble approaching the first bubble.

19. The method of claim 18 for making a microinjector head with driving circuitry wherein between the formation of the resistor layer and the conductive layer a first oxide layer is formed on the resistor layer for protecting the first heater and the second heater.

20. The method of claim 18 for making a microinjector head with driving circuitry wherein forming the dielectric layer comprises:

forming a thin oxide layer on the substrate;

forming a silicon nitride layer on the thin oxide layer;

oxidizing exposed regions of the thin oxide layer by local oxidation to form a field oxide, wherein the thin oxide layer covered by the silicon nitride layer is the first part of the dielectric layer, and the field oxide is the second part of the dielectric layer; and removing the silicon nitride layer.

21. The method of claim 18 for making a microinjector head with driving circuitry wherein forming the driving circuit comprises:

implanting boron ions into the dielectric layer;

forming a polysilicon gate on the first part of the dielectric layer; and implanting arsenic ions into the substrate for forming a source and a drain close to the gate.

22. The method of claim 18 for making a microinjector head with driving circuitry wherein the etching of the substrate and the dielectric layer to form the manifold and the chambers comprises:

back-side etching the substrate for forming the manifold;

removing the second part of the dielectric layer; and etching the substrate for forming the chambers.

23. The method of claim 18 for making a microinjector head with driving circuitry further comprising forming a second protection layer on the bubble generators for protecting the bubble generators.

24. A method for making a microinjector head with driving circuitry, comprising:

providing a substrate;

forming a dielectric layer having a first part and a second part on the substrate;

forming a driving circuit containing a plurality of functional devices on the first part of the dielectric layer;

forming a low-stress material layer on the second part of the dielectric layer;

etching the substrate and the dielectric layer to form a manifold and a plurality of fluid chambers, the manifold and the fluid chambers being connected to supply fluid to the chambers, said etching comprising:

back-side etching the substrate for forming the manifold;

removing the second part of the dielectric layer; and etching the substrate for forming the chambers;

forming aplurality of bubble generators on the low-stress material layer, the bubble generators connected to the driving circuit; and forming an orifice opening to the corresponding chamber to eject the fluid.

25. The method of claim 24 for making a microinjector head with driving circuitry wherein forming the dielectric layer comprises:

forming a thin oxide layer on the substrate;

forming a silicon nitride layer on the thin oxide layer;

oxidizing exposed regions of the thin oxide layer by local oxidation to form a field oxide, wherein the thin oxide layer covered by the silicon nitride layer is the first part of the dielectric layer, and the field oxide is the second part of the dielectric layer; and removing the silicon nitride layer.

26. The method of claim 24 for making a microinjector head with driving circuitry wherein forming the driving circuit comprises:

implanting boron ions into the dielectric layer;

forming a polysilicon gate on the first part of the dielectric layer; and implanting arsenic ions into the substrate for forming a source and a drain close to the gate.

27. The method of claim 24 for making a microinjector head with driving circuitry wherein each bubble generator has a first bubble-generating device for generating a first bubble as a virtual valve between the chamber and the manifold and a second bubble-generating device for generating a second bubble approaching the first bubble.

28. The method of claim 27 for making a microinjector head with driving circuitry wherein forming the first bubble-generating devices and the second bubble-generating devices comprise:

forming a resistor layer on the low-stress material layer for forming a first heater as the first bubble-generating device and a second heater as the second bubble-generating device; and forming a conductive layer on the resistor layer, the conductive layer and the resistor layer being connected.

29. The method of claim 28 for making a microinjector head with driving circuitry wherein between the formation of the resistor layer and the conductive layer a first oxide layer is formed on the resistor layer for protecting the first heater and the second heater.

30. The method of claim 24 for making a microinjector head with driving circuitry further comprising forming a second protection layer on the bubble generators for protecting the bubble generators.

31. A method for making a microinjector head with driving circuitry, the method comprising:

providing a substrate;

forming a dielectric layer having a first part and a second part on the substrate;

forming a driving circuit having a plurality of functional devices on the first part of the dielectric layer;

etching a portion of the second part of the dielectric layer, a sacrificial layer being formed on the etched portion of the second part of the dielectric layer;

forming a low-stress material layer on the sacrificial layer;

etching a non-driving circuit portion of the substrate and the sacrificial layer for forming a manifold and a plurality of chambers, the manifold being connected to the chambers for providing fluid to the chambers;

forming a plurality of bubble generators on the low-stress material layer, each bubble generator comprising a first bubble-generating device and a second bubble generating device, the bubble generators connected to the driving circuit, said forming comprising:

forming a resistor layer on the low-stress material layer for forming a first heater as the first bubble-generating device and a second heater as the second bubble-generating device; and forming a conductive layer on the resistor layer, the conductive layer connected to the driving circuit;

forming a plurality of orifices, each orifice connected to the chambers for ejecting the fluid.

32. The method of claim 31 for making a microinjector head with driving circuitry wherein formation of the dielectric layer comprises:

forming a thin oxide layer on the substrate;

forming a silicon nitride layer on the thin oxide layer;

local oxidizing the thin oxide layer not covered by the silicon nitride layer for forming a field oxide layer, wherein the thin oxide layer covered by the silicon nitride layer is the first part of the dielectric layer, and the field oxide layer is the second part of the dielectric layer; and removing the silicon nitride layer.

33. The method of claim 31 for making a microinjector head with driving circuitry wherein formation of the driving circuit comprises:

boron ion implanting on the dielectric layer;

forming a polysilicon gate on the first part of the dielectric layer; and arsenic ion implanting on the substrate for forming a source and a drain close to the gate.

34. The method of claim 31 for making a microinjector head with driving circuitry wherein the driving circuit is used for independently sending driving signals to each of the plurality of the bubble generators and for driving the plurality of the bubble generators.

35. The method of claim 31 for making a microinjector head with driving circuitry wherein the functional device is a transistor.

36. The method of claim 35 for making a microinjector head with driving circuitry wherein the transistor is a metal oxide semiconductor field effect transistor (MOSFET).

37. The method of claim 31 for making a microinjector head with driving circuitry wherein the etching of the substrate and the sacrificial layer for forming the manifold and the chambers comprises:

back-side etching the substrate for forming the manifold;

removing the sacrificial layer that does not cover the driving circuit; and back-side etching the substrate for forming the chambers.

38. The method of claim 31 for making a microinjector head with driving circuitry wherein between the formation of the resistor layer and the conductive layer a first oxide layer is formed on the resistor layer for protecting the first heater and the second heater.

39. The method of claim 31 for making a microinjector head with driving circuitry wherein the method further comprises forming a second oxide layer on the bubble generators for protecting the bubble generators.

40. A method for making a microinjector head with driving circuitry, the method comprising:

providing a substrate;

forming a dielectric layer having a first part and a second part on the substrate, said forming comprising:

forming a thin oxide layer on the substrate;

forming a silicon nitride layer on the thin oxide layer;

local oxidizing the thin oxide layer not covered by the silicon nitride layer for forming a field oxide layer, wherein the thin oxide layer covered by the silicon nitride layer is the first part of the dielectric layer, and the field oxide layer is the second part of the dielectric layer; and removing the silicon nitride layer;

forming a driving circuit having a plurality of functional devices on the first part of the dielectric layer;

etching a portion of the second part of the dielectric layer, a sacrificial layer being formed on the etched portion of the second part of the dielectric layer;

forming a low-stress material layer on the sacrificial layer;

etching a non-driving circuit portion of the substrate and the sacrificial layer for forming a manifold and a plurality of chambers, the manifold being connected to the chambers for providing fluid to the chambers;

forming a plurality of bubble generators on the low-stress material layer, the bubble generators connected to the driving circuit; and forming a plurality of orifices, each orifice connected to the chambers for ejecting the fluid.

41. The method of claim 40 for making a microinjector head with driving circuitry wherein formation of the driving circuit comprises:

boron ion implanting on the dielectric layer;

forming a polysilicon gate on the first part of the dielectric layer; and arsenic ion implanting on the substrate for forming a source and a drain close to the gate.

42. The method of claim 40 for making a microinjector head with driving circuitry wherein the driving circuit is used for independently sending driving signals to each of the plurality of the bubble generators and for driving the plurality of the bubble generators.

43. The method of claim 40 for making a microinjector head with driving circuitry wherein the functional device is a transistor.

44. The method of claim 43 for making a microinjector head with driving circuitry wherein the transistor is a metal oxide semiconductor field effect transistor (MOSFET).

45. The method of claim 40 for making a microinjector head with driving circuitry wherein the etching of the substrate and the sacrificial layer for forming the manifold and the chambers comprises:

back-side etching the substrate for forming the manifold;

removing the sacrificial layer that does not cover the driving circuit; and back-side etching the substrate for forming the chambers.

46. The method of claim 40 for making a microinjector head with driving circuitry wherein each of the bubble generators has a first bubble-generating device and a second bubble-generating device.

47. The method of claim 46 for making a microinjector head with driving circuitry wherein the formation of the bubble generators comprises:

forming a resistor layer on the low-stress material layer for forming a first heater as the first bubble-generating device and a second heater as the second bubble-generating device; and forming a conductive layer on the resistor layer, the conductive layer connected to the driving circuit.

48. The method of claim 47 for making a microinjector head with driving circuitry wherein between the formation of the resistor layer and the conductive layer a first oxide layer is formed on the resistor layer for protecting the first heater and the second heater.

49. The method of claim 40 for making a microinjector head with driving circuitry wherein the method further comprises forming a second oxide layer on the bubble generators for protecting the bubble generators.

* * * * *